US007004631B1

(12) United States Patent
Egashira et al.

(10) Patent No.: US 7,004,631 B1
(45) Date of Patent: Feb. 28, 2006

(54) PORTABLE LAUNDRY BAG

(75) Inventors: Kyoko Egashira, Tokyo (JP); Tatsuya Ito, Tokyo (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 54 days.

(21) Appl. No.: 10/401,516

(22) Filed: Mar. 28, 2003

(51) Int. Cl.
*B65D 33/16* (2006.01)

(52) U.S. Cl. ..... 383/64; 383/41; 383/117

(58) Field of Classification Search ..... 383/41, 383/63–64, 66–67, 100, 117
See application file for complete search history.

(56) References Cited

U.S. PATENT DOCUMENTS 5,240,112 A * 8/1993 Newburger ..... 206/524.8
5,709,479 A * 1/1998 Bell ..... 383/209
5,785,428 A * 7/1998 Mazzocchi ..... 383/103
6,200,027 B1 * 3/2001 Jones ..... 383/40
6,789,947 B1 * 9/2004 Kasai ..... 383/64

* cited by examiner

*Primary Examiner*—Jes F. Pascua
(74) *Attorney, Agent, or Firm*—Ladas & Parry LLP

(57) ABSTRACT

A portable laundry bag formed by providing bag opening and closing members on at least two portions of a bag body, forming the bag opening and closing members by slider-carrying bag opening and closing fasteners having male and female seal hooks, providing at least one of the bag opening and closing fasteners at the side of an opening thereof with male and female slider guide hooks so that the slider guide hooks extend in parallel with the seal hooks, disposing inner-side guides of the sliders so that the inner-side guides are positioned between the seal hooks and slider guide hooks, providing on at least one portion of the bag body with an outflow of laundry preventing member. Thus, the object of the invention is to provide a clean and small-weight portable laundry bag as traveling goods capable of being transported, handled simply, and thrown away after its use.

12 Claims, 11 Drawing Sheets

PORTABLE LAUNDRY BAG

BACKGROUND OF THE INVENTION

1. Field of the Invention

This invention relates to a portable laundry bag, and more particularly to a portable laundry bag capable of being held without bulking large in a suitcase, a traveling bag and the like, having a cleanness, small weight and an easiness to handle, and possible to be thrown away after use substantially non-wastefully.

2. Description of the Background Art

The present invention provides a portable laundry bag provided at an edge thereof with an openable fastener exclusively used for the rinsing of laundry and having a waterproofing function; a newly devised structure provided in the vicinity of the fastener and including spot-fused portions and a netlike portion for preventing the laundry from flowing out to the outside during the rinsing and dehydration of the laundry; and capable of carrying out the washing, rinsing and dehydrating of the laundry in one simple bag easily without wetting a floor, etc. of a room.

When long-term domestic and overseas travels and a long-term business trip, etc. are made, a traveler takes large baggage, in which change of clothes including change of underwear is packed in large quantities in most cases. A traveler can have his shirts or her blouses among the clothes washed in a laundry and a coin-operated laundry outside, whereas he and she are reluctant to have their underwear washed in a laundry specializing in cleaning clothes.

Under the circumstances, a traveler practically washes by himself his underwear in a guest room, etc. in a building in his destination with a cake of soap, a detergent and the like by utilizing a sink and a bathtub, the cleanness of which is not ensured, in the room while spending his labor and time.

The inventor of the invention proposed in the patent specification submitted on Feb. 12, 2002 a portable washing machine having small weight and bulk and capable of being carried about by a traveler and handled simply by himself in his room in the destination. Namely, the inventor proposed a portable washing machine provided with a takeout port and a supply port at upper and lower portions thereof respectively, and a netted shelf in the interior of a foldable washing vessel body, and formed so as to place clothes to be washed on the netted shelf, and circulate washing water through the washing vessel via the takeout port and supply port by a liquid sending pump.

This portable washing machine is provided with a netted shelf in a washing vessel, and adapted to circulate washing water through the interior of the washing vessel by a liquid sending pump. Namely, pipes around the pump as well as the netted shelf and liquid sending pump necessarily come to be needed. Therefore, this washing machine could not satisfy a traveler with respect to the portability and weight thereof since the washing machine could not execute a laundry washing operation simply in an objective room in which he stays on his journey.

Furthermore, the inventor of the invention proposed on Oct. 10, 2001 a portable laundry bag provided with bag opening and closing members at two portions of a bag body, and at least one spot-fused portion in the vicinity of either one of the bag opening and closing members, so as to prevent the laundry from being sprung out to the outside during a water discharge operation carried out after a washing operation.

However, this portable laundry bag was unsatisfactory with respect to the sealability of the bag body. In short, the sealability of bag opening and closing slide fasteners as the bag opening and closing members is insufficient, and there was the possibility that the washing water leaked out from small spaces in the bag opening and closing members during the washing time, dehydration time and the lile.

SUMMARY OF THE INVENTION

The invention has been made in view of these circumstances, and one of the objects of the invention is to provide a clean and small-weight portable laundry bag as traveling goods capable of being carried with a bag body not bulking large, capable of being handled simply even in a guest room in the destination of a travel and an outing, and possible to be thrown away after use substantially non-wastefully.

This object of the invention is achieved effectively by providing bag opening and closing members on at least two portions of a bag body made of a flexible sheet material, forming the bag opening and closing members by slider-carrying bag opening and closing fasteners having male and female seal hooks, providing at least one of the bag opening and closing fasteners at the side of an opening thereof with male and female slider guide hooks so that the slider guide hooks extend in parallel with the seal hooks, disposing inner-side guides of the sliders so that the inner-side guides are positioned between the seal hooks and slider guide hooks, providing on at least one portion of the bag body with an outflow of laundry preventing member, by which the springing-out of the laundry to the outside is prevented during a water discharging operation carried out after the completion of a laundry washing operation.

This object of the invention is achieved effectively by forming the slider guide hooks by projections extending toward the inside of the female hooks.

The object of the invention is achieved effectively by forming the male and female seal hooks into a seal structure by providing a pressure claw on an inner side of the female hook of the male and female seal hooks, the pressure claw being pressed during a bag sealing operation against a bifurcated male hook projecting toward the side of the male hook.

The object of the invention is achieved effectively by forming the bag opening and closing fasteners so that one bag opening and closing fastener member is made of a regular bag opening and closing fastener with the other made of a seal type bag opening and closing fastener member. The object of the invention is achieved effectively by forming the outflow of laundry preventing member by a netted member.

The object of the invention is achieved effectively by forming the bag opening and closing members an openable and waterproofing function-carrying bag opening and closing fastener provided on one of edges of the bag body, and an openable and a waterproofing function-carrying bag opening and closing fastener having an outflow of laundry preventing portion in the vicinity thereof and used exclusively for a water discharging operation; and forming the bag opening and closing members in the bag opening and closing fasteners provided on an upper end portion and a lower end portion of the bag body.

The object of the invention is achieved effectively by providing two bag opening and closing units on edges of a bag body made of a flexible sheet material, arranging one or a plurality of small water discharge ports in parallel with each other in the vicinity of either one of the bag opening and closing units, sealing the small ports with an adhesive tape at the time of starting a laundry washing operation, and peeling off the adhesive tape at the time of starting discharging the water from the interior of the bag body.

The object of the invention is achieved effectively by arranging one or a plurality of small water discharge ports in the vicinity of a lower end portion of the bag body in parallel with each other, sealing the small ports with an adhesive tape at the time of starting a laundry washing operation, peeling off the adhesive tape at the time of starting discharging the water from the interior of the bag body, and setting the diameter of the small water discharge ports to around 1 cm.

The object of the invention is achieved more effectively by making the bag body of a transparent plastic film.

In order to achieve the objects, the invention provides on one of edges of a bag body, which is used to put laundry, a detergent and cleaning city water therein, with an openable waterproofing function-carrying bag opening and closing fastener, and on the other with an openable waterproofing function-carrying bag opening and closing fastener which has an outflow of laundry preventing portion formed in the vicinity thereof so that the outflow of laundry preventing portion does not obstruct a water discharging operation, and which is used exclusively for a water discharging operation. These two fasteners of different functions provided on one bag enable the laundry to be immersed in the washing water in which a detergent is sufficiently dissolved while simply shaking and rubbing the laundry with the bag kept waterproofed, the laundry to be then left as it is for a suitable period of time, the washing of the laundry to be done with a surface activating action of the detergent displayed to a maximum extent, and the rinsing of the laundry to be thereafter done within the same bag.

A front view of an embodiment of the portable laundry bag according to the invention.

FIG. 2

A perspective view showing the condition of a bag opening and closing fastener provided on an upper portion of a bag body.

FIG. 3A

Figure 2:
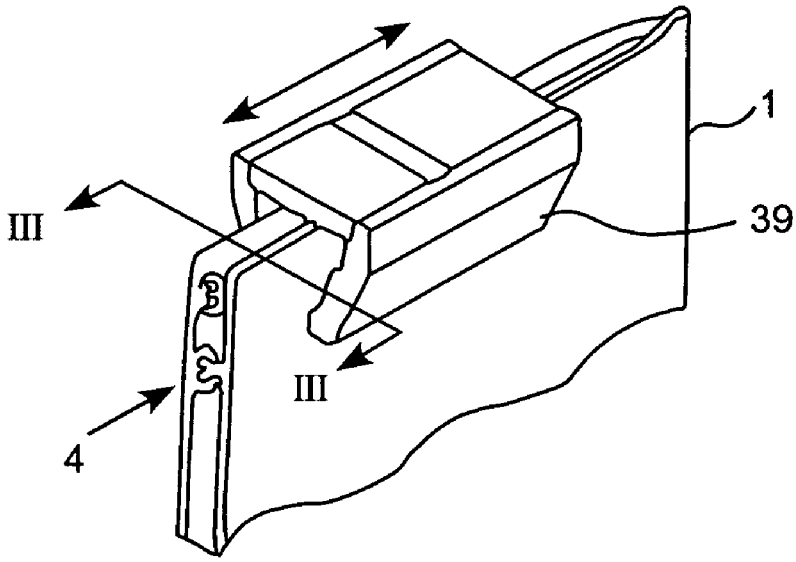

A sectional view of the bag opening and closing fastener taken along the line III—III in FIG. 2 and having seal type fastener members provided at upper and lower portions thereof.

FIG. 3B

Figure 3A:
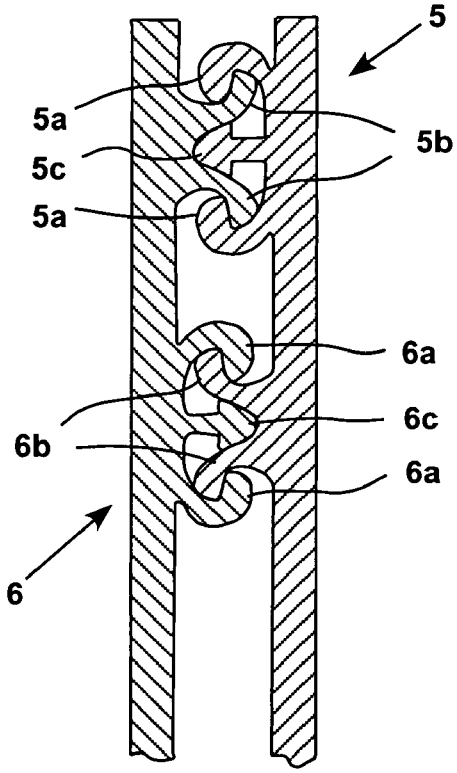

A sectional view showing a modified example of the bag opening and closing fastener of FIG. 3A, showing the condition of a projection and seal type fastener members provided at upper and lower portions thereof.

FIG. 3C

A sectional view showing a modified example of the bag opening and closing fastener of FIG. 3A, showing the condition of a regular type and seal type fastener members provided at upper and lower portions thereof respectively.

FIG. 3D

A sectional view of a modified example of the bag opening and closing fastener of FIG. 3A, showing the condition of a projection and a regular type fastener member at upper and lower portions thereof respectively.

FIG. 4

A perspective view showing an external appearance of a slider of the bag opening and closing fastener.

FIG. 5

Figure 1:
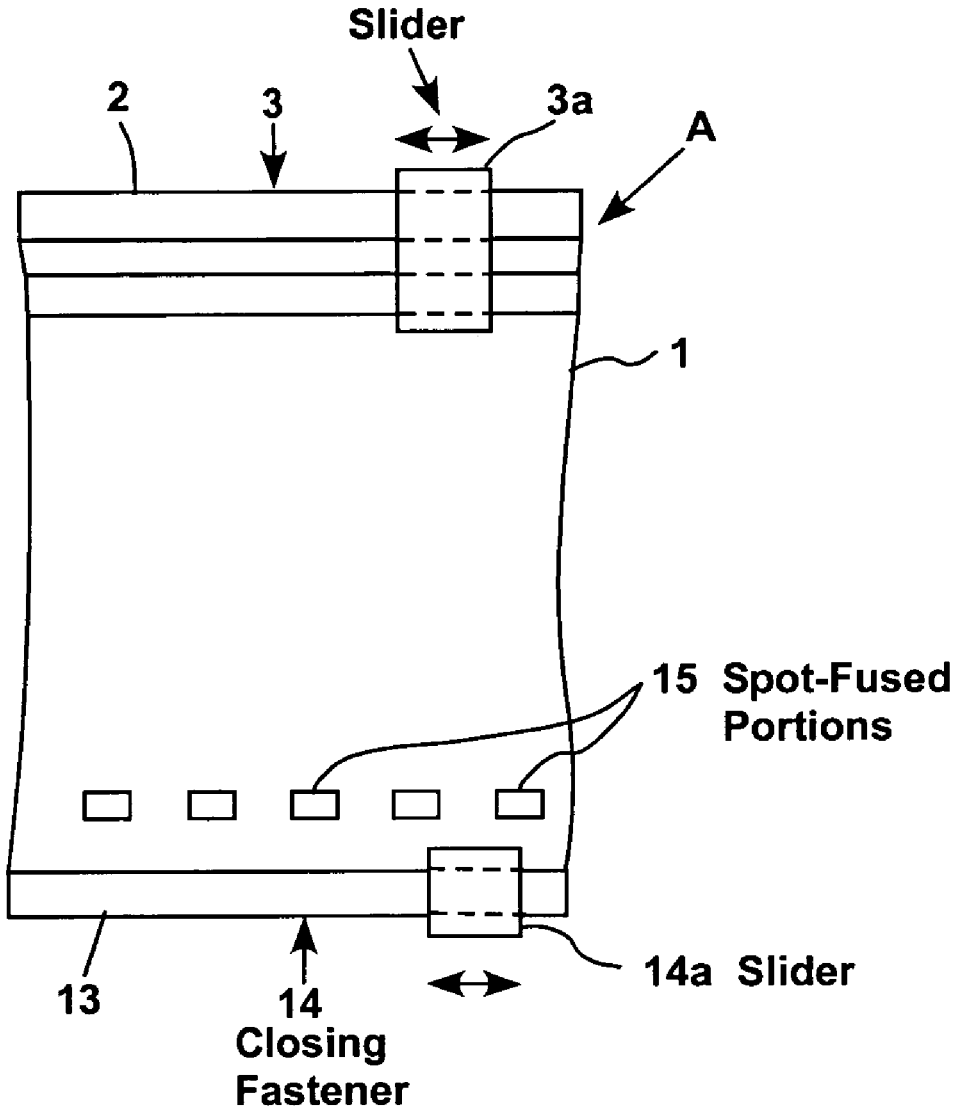
FIG. 1

A drawing corresponding to FIG. 1, showing the condition of a netted member used for preventing the laundry from flowing out of the bag.

FIG. 6

A front view of a modified example of the portable laundry bag of FIG. 1, in which a bag is opened and closed by using two sliders.

FIG. 7

A drawing corresponding to FIG. 1, showing the condition of laundry outflow preventing spot-fused portions arranged in the vertical direction of a bag body.

FIG. 8

Figure 5:
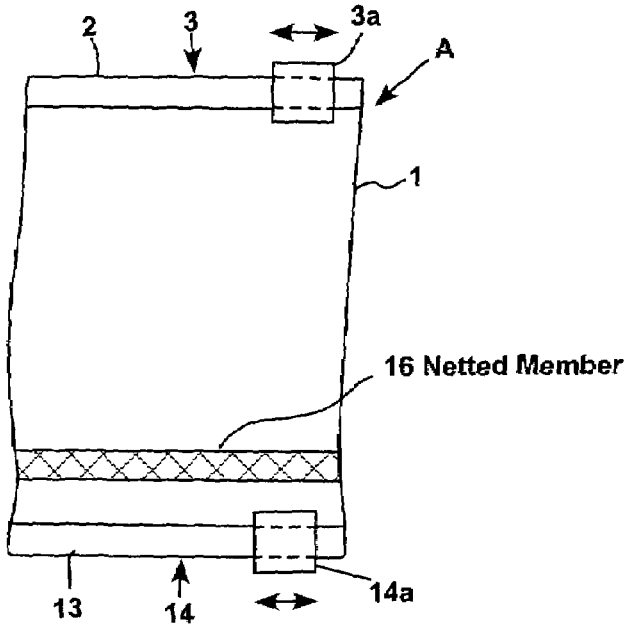

A drawing corresponding to FIG. 5, showing the condition of an outflow of laundry preventing netted member provided so as to extend in the vertical direction of a bag body.

FIG. 9

A drawing showing the condition of a switch valve provided at a lower end portion of a bag body and adapted to control the outflow of waste water.

FIG. 10

Figure 9:
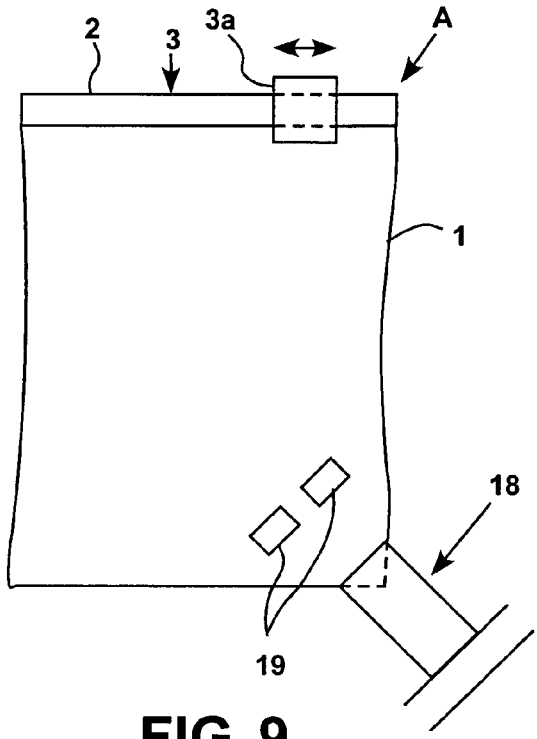

A drawing showing the condition of a switch valve, which is identical with the switch valve of FIG. 9, and which is provided in a central portion of a lower end of a bag body.

FIG. 11

A drawing corresponding to FIG. 1, showing a water discharge port provided at a part of a lower end of a bag body.

FIG. 12

A drawing corresponding to FIG. 5, showing a water discharge port provided at a part of a lower end of a bag body.

FIG. 13

Figure 11:
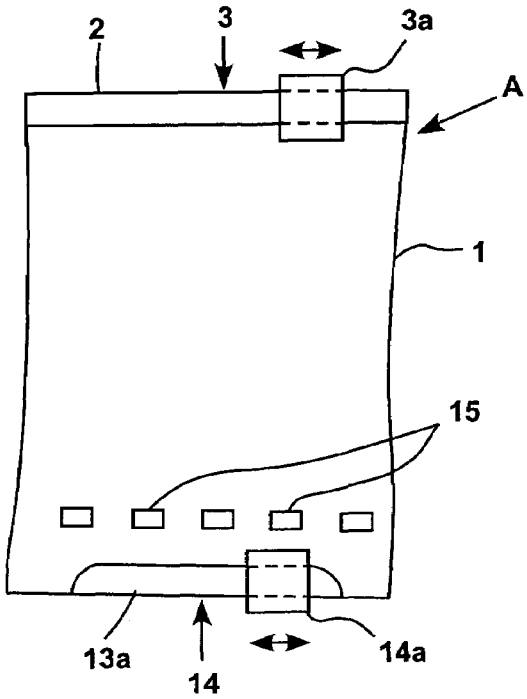

A drawing corresponding to FIG. 11, showing a water discharge port provided at a right corner of a lower end of a bag body.

FIG. 14

Figure 12:
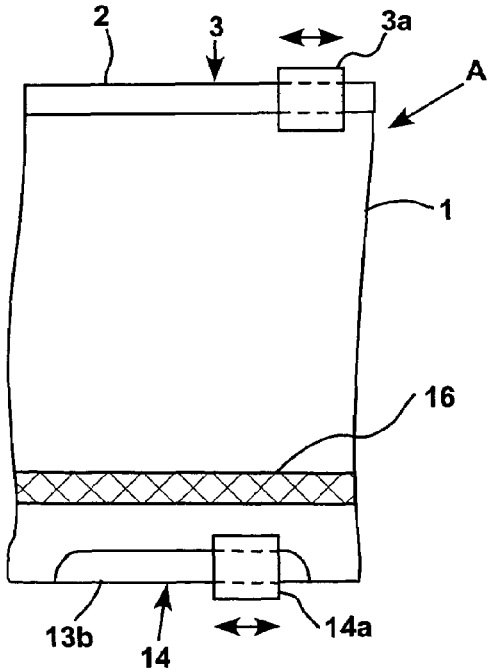

A drawing corresponding to FIG. 12, showing a water discharge port provided at a right corner of a lower end of a bag body.

FIG. 15

A drawing corresponding to FIG. 1, showing the condition of laundry inserted into a bag body at the time of starting a laundry washing operation and the like.

FIG. 16

A drawing corresponding to FIG. 5, showing the condition of laundry inserted into a bag body at the time of starting a laundry washing operation and the like.

DETAILED DESCRIPTION OF THE PREFERRED EMBODIMENTS

A preferred mode of embodiment of the invention will now be described with reference to the drawings.

FIG. 1 shows a portable laundry bag (which will hereinafter be referred to as "laundry bag") A of one embodiment of the invention. Referring to the drawing, a reference numeral 1 denotes a bag body made of a flexible sheet material, the bag body 1 being provided at an upper end thereof with an opening (from which laundry, a detergent and water will be inserted) 2, around which a bag opening and closing fastener 3 is fixed. This bag opening and closing fastener 3 is adapted to open and close the opening 2 by moving a slider 3*a* in the directions of an arrow. The opening 2 is adapted to allow the entry of laundry, detergent, water, etc. inserted therein when the opening 2 is opened by the bag opening and closing fastener 3.

The bag opening and closing fastener 3 is provided with a seal unit 4 extending along an upper end of the bag body 1 as shown in, for example, FIG. 2. The seal unit 4 is provided with seal type fastener members 5, 6 at upper and lower portions thereof as shown in an enlarged and detailed state in FIG. 3A, to form a doubly sealed structure. These seal type fastener members 5, 6 include paired female and male hooks parallel-extending along an opening edge of the bag body 1, i.e. female hooks 5*a*, 6*a* and male hooks 5*b*, 6*b*. On the inner side of the female hooks 5*a*, 6*a*, central pressure claws 5*c*, 6*c* project respectively toward the opposed male hooks 5*b*, 6*b*. During a sealing operation by the central pressure claws 5*c*, 6*c*, the bifurcated type male claws 5*b*, 6*b* are pressed thereby, and engaged portions of the female hooks 5*a*, 6*a* and male hooks 5*b*, 6*b* are maintained in a sealed state.

Figure 4:
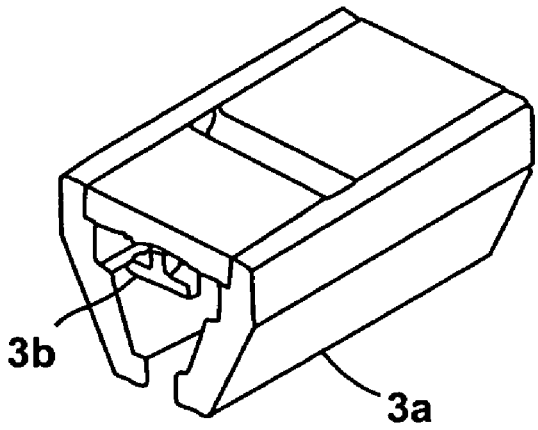

The slider 3*a* is provided on an inner side thereof with an inverted T-shaped locking projection 3*b* as shown in FIG. 4, and this locking projection 3*b* is provided so as to be positioned between the upper and lower seal type fastener members 5, 6. Therefore, when the slider 3*a* is moved in the directions of an arrow of FIG. 2 to cause the female hooks 6*a* and male hooks 6*b* to be engaged with each other, the seal unit 4 is opened and closed.

The slider 3*a* is disposed so that the locking projection 3*b* is positioned between the upper and lower seal type fastener members 5, 6 provided at an upper end of the bag body 1. Therefore, when the slider 3*a* is moved in either one direction so as to open the bag body 1, the locking projection 3*b* exerts power on the upper seal type fastener member 5 in the direction in which the same fastener is expanded outward. Consequently, the outwardly expanding power is exerted on the lower seal type fastener 6 as well to cause the paired female and male hooks of the seal type fastener members 5, 6 to be disengaged from each other, and the bag body 1 to be thereby opened. On the other hand, in order to seal the bag body 1, the slider 3*a* is moved in the reverse direction, so that the parts are moved in the direction opposite to the direction in which the parts are moved when the bag body 1 is opened. Namely, the seal unit 4 is sealed with a double bag opening and closing structure by engaging the female hooks 5*a*, 6*a* and male hooks 5*b*, 6*b* with each other by the locking projection 3*b*. Therefore, the leakage of water from the interior of the bag body 1 is prevented.

When seal type fastener members are used as the seal unit 4 in this embodiment, the bag body can be opened from the outside at the female hooks 5*a* but cannot from the inside. Moreover, since the female hooks 5*a* are provided on an outer side, the tightening force of the female hooks 5*a* increases (self-seal mechanism) owing to an external force, so that the sealability of the bag body can be maintained stably even with respect to an internal pressure and a negative pressure. Therefore, the sealability and impact resistance of the seal unit 4 are improved, and, even when the bag body 1 is dropped with a heavy object and a liquid held therein, the bag opening and closing fastener 3 is not opened easily.

In this embodiment, the upper and lower seal type fastener members 5, 6 are provided so that the fastener members 5, 6 face in the opposite directions. The seal type fastener members 5, 6 may also be provided so that the fastener members face in the same direction, and the central pressure claws 5*c*, 6*c* extending from the female hooks 5*a*, 6*a* may be set so as to face in the same direction, and pressed against the male hooks 5*b*, 6*b*. This arrangement displays the same effects as are described above.

Although the seal unit 4 is provided at the upper and lower portions thereof with seal type fastener members 5, 6 as shown in FIG. 3A, the invention is not limited to this structure. A double seal structure serves the purpose as long as the structure is adapted to reliably seal the interior of the bag body 1.

Figure 3B:
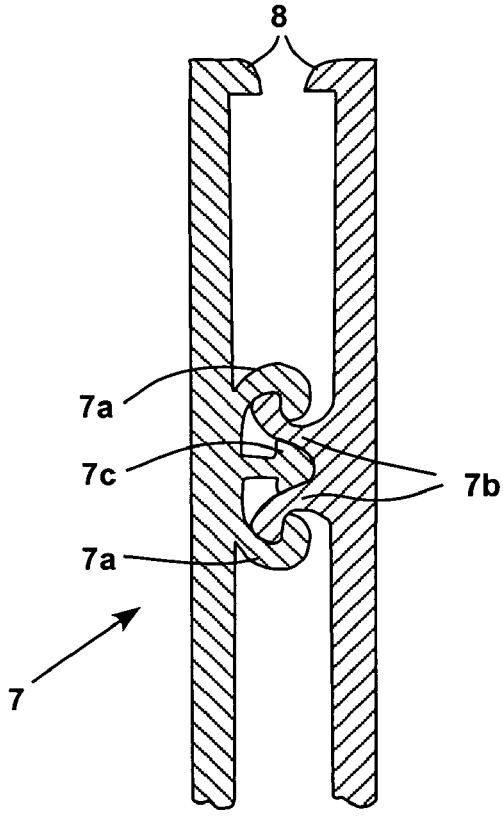

As shown in, for example, FIG. 3B, a seal type fastener member 7 is provided at a lower portion of a seal unit, and rib-like projections 8 extending inward along an opening edge of a bag body 1 may be provided at an upper portion of the seal unit instead of a seal type fastener member. A locking projection 3*b* of a slider 3*a* may then be disposed so that the locking projection 3*b* is positioned between a seal type fastener member 7 and projections 8, and the slider 3*a* may thereby be moved along an upper edge of the bag body 1. In this example, the leakage of water from the interior of the bag body 1 can be prevented, and effects identical with those described above can be displayed. Reference numerals 7*a* and 7*b* denote female hooks and male hooks, and a reference numeral 7*c* a central pressure claw.

Figure 3C:
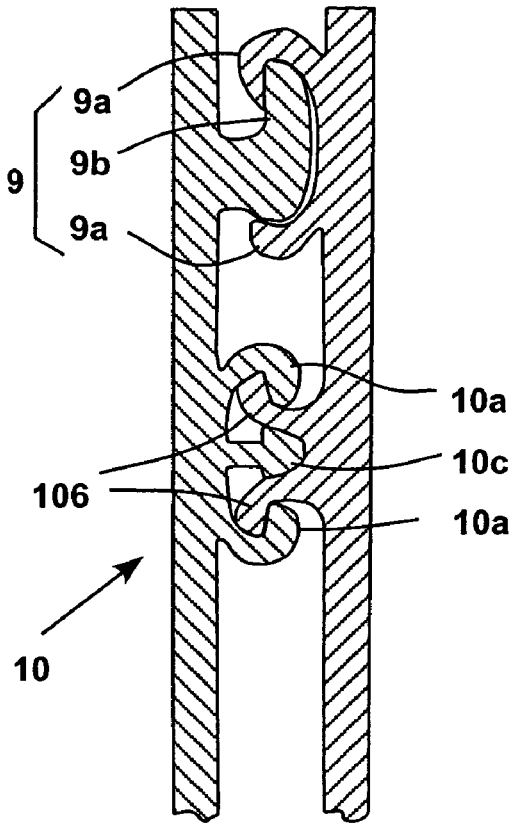

As shown in FIG. 3C, a regular type fastener member and a seal type fastener member may be provided at an upper portion and a lower portion respectively of a seal unit. Conversely, a seal type fastener member and a regular type fastener member may be provided at an upper portion and a lower portion respectively of a seal unit. In this case, a seal unit 4 forms a double seal structure including a regular type fastener member 9 and a seal type fastener member 10. This seal structure can seal the interior of a bag body 1 reliably. Reference numerals 9*a* and 9*b* denote a female hook and a male hook respectively, 10*a*, 10*b* a female hook and a male hook respectively, and a reference numeral 10*c* a central pressure claw.

Figure 3D:
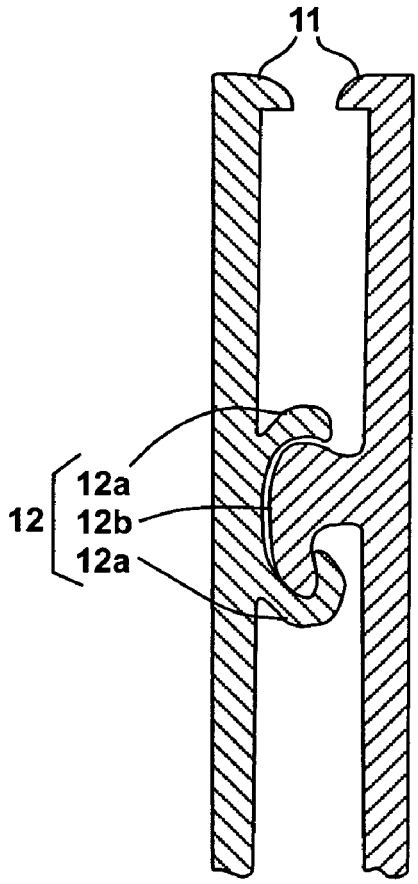

As shown in FIG. 3D, it is allowable to provide at an upper portion of a seal unit rib-like projections 11 extending inward along an edge of an opening of a bag body 1, and at a lower portion of the seal unit a regular type fastener 12. In this case, the regular type fastener member 12 also includes paired female and male hooks 12*a*, 12*b* extending in parallel with an edge of an opening of the bag body 1. When a slider 3*a* is operated, the female hooks 12*a* and male hook 12*b* are engaged with each other, and an opening 2 is thereby opened and closed. Owing to this arrangement, the interior of a bag body 1 can be sealed reliably, and the effects identical with those of the above-described embodiments are displayed.

As a material for the bag body 1, a sheet material having a flexibility, a transparency and a tear strength, for example, a plastic film of PET (polyethylene terephthalate) and the like. The bag opening and closing fastener is made of a plastic and the like.

In the vicinity of a lower end portion of the bag body 1, a discharge port 13 for washing water is provided as shown in FIG. 1, and a bag opening and closing fastener 14 is fixed to the water discharge port 13. The bag opening and closing fastener 14 is adapted to open and close the water discharge port 13 by moving a slider 14*a* in the directions of an arrow in FIG. 1.

A plurality of spot-fused portions 15 are provided in a lateral row at the portion of the bag body 1 which is in the vicinity of a lower end thereof (in the lateral direction of FIG. 1) so as to prevent laundry from flowing out. Instead of the spot-fused portions 15, a netted member 16 may be provided in a belt-like form as shown in FIG. 5, at the portion of a bag body 1 which is in the vicinity of a lower end thereof so that the netted member extends laterally (in the lateral direction of FIG. 5) for the purpose of preventing laundry from flowing out from a water discharge port.

Figure 6:
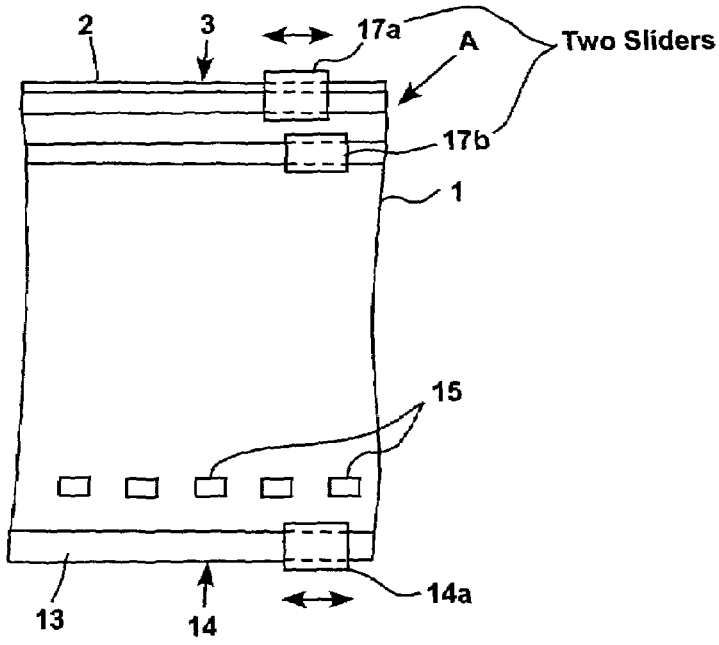

As shown in FIG. 6, a bag body 1 may be sealed by two opening and closing operations of bag opening and closing fasteners by using two sliders 17*a*, 17*b*.

Figure 7:
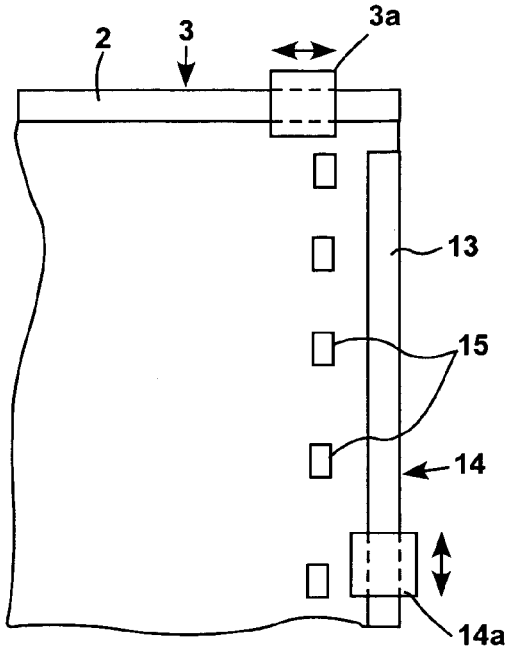
Figure 8:
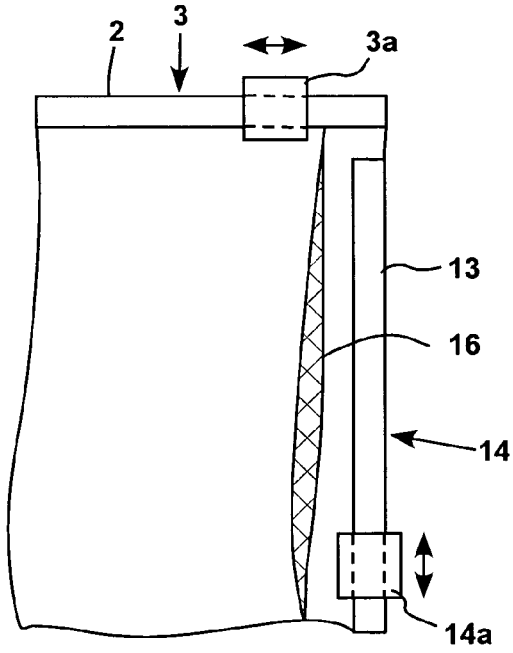

The spot-fused portions 15 and netted member 16 for preventing laundry from flowing out from a water discharge port may be provided vertically as shown in FIG. 7 and FIG. 8.

In this structure, the laundry does not flow out from the water discharge port 13 owing to the spot-fused portions 15 and netted member 16 during the rinsing and dehydrating of the laundry, and only the waste water flow out to the outside.

Figure 10:
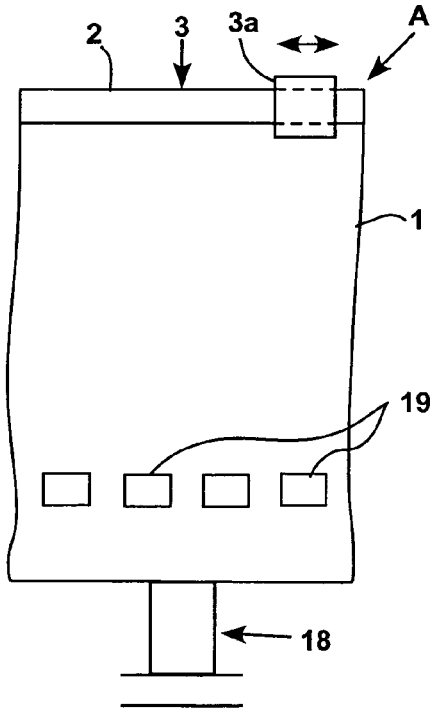

As shown in FIG. 9, a switch valve 18 for discharging water from a bag body 1 is provided at either one corner of a lower end of the bag body 1. Spot-fused portions 19 are provided at the part of a bag body 1 which is in the vicinity of a lower end thereof. During a laundry washing operation, the washing water is not discharged by closing a switch valve 18, while, during the laundry rinsing and dehydrating operations, only the water in the bag body 1 is discharged by opening the switch valve 18, the laundry being thus not sprung out to the outside. It is also allowable to provide a switch valve 18 in the central portion of a lower end of a bag body 1 and spot-fused portions 19 at the part of the bag body 1 which is in the vicinity of the lower end thereof as shown in FIG. 10, so as to prevent laundry from springing out to the outside during a dehydration operation, etc. The type and construction of the switch valve 18 are not limited, and, any switch valve will do as long as the valve can open and close an opening of the bag body 1.

FIG. 11 and FIG. 12 are drawings corresponding to FIG. 1 and FIG. 5 respectively, which show examples in each of which bag opening and closing fasteners 14 are provided at a portion of a lower end of a bag body 1. FIG. 11 shows an example provided with spot-fused portions 15 at the portion of a bag body 1 which is in the vicinity of a lower end thereof, and FIG. 12 an example provided with a netted member 16 at a similar portion of a bag body. Water discharge ports 13*a*, 13*b* adapted to be opened and closed by bag opening and closing fasteners 14 are provided at portions of the lower ends of the bag bodies 1. In short, the examples of FIG. 1 and FIG. 5 are provided with water discharge ports 13 extending over the whole of the lower ends of the bag bodies 1, while the examples of FIG. 11 and FIG. 12 are provided with water discharge ports 13*a*, 13*b* at parts of the lower ends of the bag bodies 1.

Figure 13:
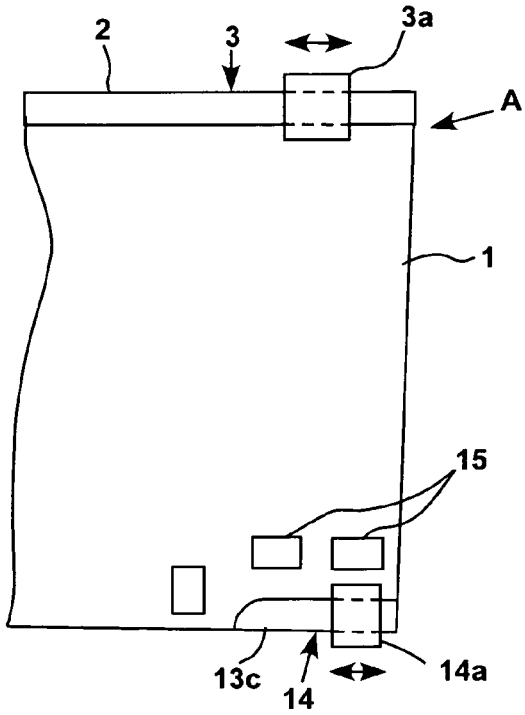
Figure 14:
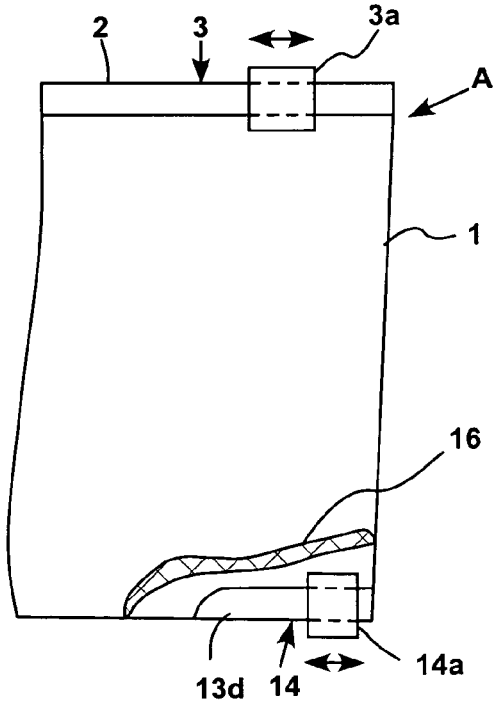

FIG. 13 and FIG. 14 show examples each of which is provided with bag opening and closing fasteners 14 at either one corner portion of a lower end of a bag body 1. In such examples, a water discharge port 13*c* or 13*d* opened and closed by the bag opening and closing fasteners 14 is provided.

The operation in use of the portable laundry bag thus formed will now be described.

Figure 15:
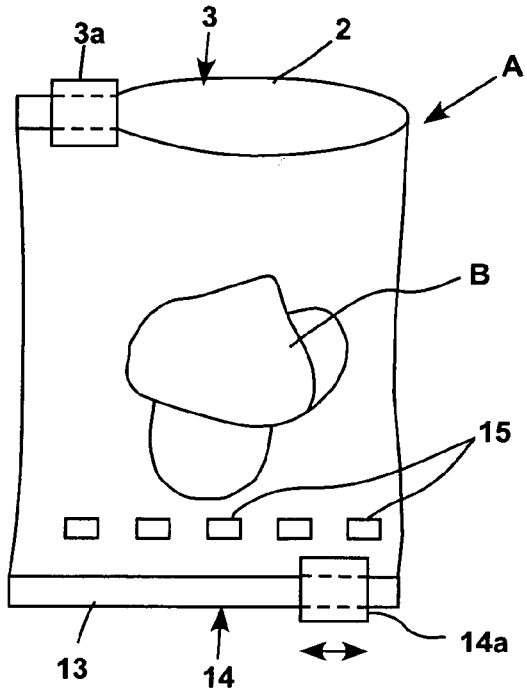
Figure 16:
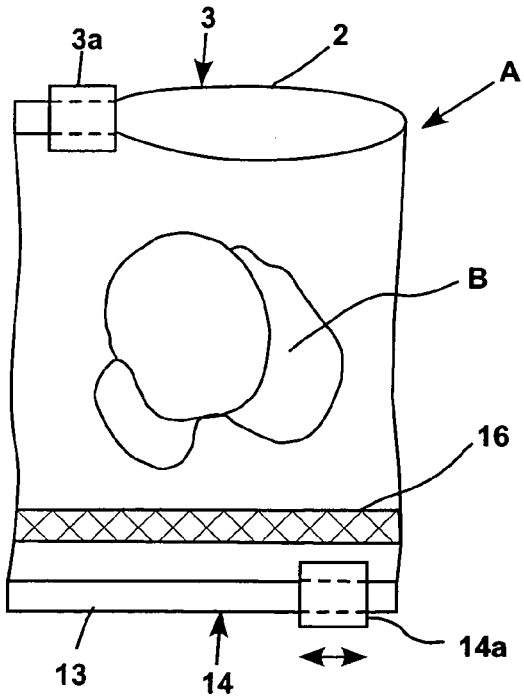

First, in order to make preparations for washing laundry, the laundry bag stored is taken out, and as shown in FIGS. 15 and 16, the slider 3*a* of the bag opening and closing fastener 3 of the bag body 1 is moved to expand the opening 2 at the upper end of the bag body 1, laundry B being then put in the interior thereof. The resultant bag body 1 is placed in a sink. It is desirable that the weight of the laundry B to be washed at a time be 400 to 500 g at most. The weight of underwear per overnight stay is usually around 200 g on an average, though the weight thereof varies depending upon the climate of a destination of a travel or a business trip and the number of overnight stay.

Cold water or hot water is then sent out from a faucet (not shown), and the bag body 1 is filled with the water. The quantity of the water is set to around a level at which the laundry B is completely immersed therein. It is desirable that the laundry be thereafter left immersed in the water for a while. When the laundry B is thus left as it is, the fibers in the laundry B are subjected to collective actions, such as permeation, emulsification, dispersion and the like by the surface active components contained in a detergent, and a greater part of a small quantity of soil and odor deposited on the laundry B is removed. All preparatory operations are completed by such simple actions.

In order to start the washing of the laundry, it is effective to give a pressure thereto by rubbing the bag body 1 from both side portions thereof and shaking the bag body laterally and vertically so as to promote the surface activating actions of the detergent. Especially, when the dirtiness of the laundry B is hard, very much effect is displayed. Since the interior of the bag body 1 is seen through, the degree of removal of the soil from the laundry B can be ascertained from the outside.

After the removal of the soil from the laundry B is ascertained, or, after a predetermined period of time elapses, the bag opening and closing fastener 14 at the lower end of the bag body for the water discharge port 13 is opened by moving the slider 14*a*, and the water with which the laundry B has been cleaned is discharged. During this time, the laundry B does not flow out to the outside owing to the laundry outflow-preventing spot-fused portions 15. After the water discharging operation is completed, the bag opening and closing fastener 14 is closed.

After the closure of the bag opening and closing fastener 14 at the lower end of the bag body is ascertained, the opening 2 at the upper end thereof is opened again, and fresh rinsing water is sent from the faucet into the bag body 1. These operations are repeated until the bubbles in the bag body 1 disappear. As a result, the rinsing of the laundry is completed.

In other case, the water is made to flow from the opening 2 at the upper end of the bag body 1 thereinto continuously with the bag opening and closing fastener 14 at the lower end portion of the bag body opened, until the bubbles on the laundry B disappear, to finish the rinsing of the laundry. The place used to conduct this laundry washing operation is limited to an inner portion of a sink or bathtub. At a point in time at which the bubbles in the bag body disappear, the supplying of the water is stopped. The laundry B is thereafter dehydrated by winding up the bag body 1 from one side thereof with the laundry B left held therein, so as to squeeze out the water contained in the laundry B from the other side of the bag body 1.

A portable laundry bag provided with small water discharge ports at the portion of a bag body 1 which is in the vicinity of a lower end thereof, instead of the spot-fused portions 15, and an adhesive tape with which the small water discharge ports are sealed will now be described. The preparatory and laundry washing operations conducted in this portable laundry bag are completely identical with those conducted in the above-described embodiment. In order to carry out a laundry rinsing operation, the adhesive tape pasted in advance on the bag body so as to seal the small ports may only be peeled off. As a result, the water finished being used to wash the laundry flows out from the small water discharge ports. The rinsing of the laundry is done by opening the bag opening and closing fastener 3 from an opening 2 at an upper end of the bag body, and having the water flow thereinto continuously. When the bubbles on the laundry B disappear, the supplying of the water is stopped.

When these operations finish, the laundry B is taken out from the bag body 1 and the laundry is transferred to a suitable place and dried. At the same time, the bag body 1 is also dried, and, after the bag body 1 is dried, the bag body 1 is folded or wound up and put away. Even when the bag body 1 is folded, a total thickness thereof reaches only around several millimeters since the bag body 1 is made of an extremely thin plastic film. Therefore, this bag body can be stored in a corner portion of a traveling bag and a suitcase without bulking large. A worn-out or soiled laundry bag is discarded as non-combustible waste. Since this laundry bag can be mass-produced at a low cost, and provided at a low price for users, the bag can be thrown away after use substantially non-wastefully.

In the above embodiment, the bag body 1 has a tear strength. Therefore, even when the bag body 1 receives a high hydraulic pressure or is pressed forcibly from the outside, the bag body is not blown out. Since an inner portion of the bag body can be seen through, the condition of the laundry B being washed can be ascertained from the outside. Furthermore, while the laundry bag is not in use, the laundry bag is folded or wound up. The resultant laundry bag can be compactly held in something and transported.

The invention is not limited to the above-described embodiments, and can be modified variously with respect to the construction thereof. It is a matter of course that a position in which the parts are provided, and a shape, or number and quantity, etc. of the parts can be varied arbitrarily as necessary.

According to the portable laundry bag of the invention described above, the bag body as a whole can be folded or wound up, so that it is possible to store the laundry bag compactly in a corner portion of a traveling bag, a suitcase and the like, and transport the same. This enables the volume of hand baggage to be reduced, and the number thereof to be minimized. Therefore, this portable laundry bag has the advantage of being transferred conveniently.

In order to seal the bag body 1, a double seal structure having a combination of seal type and regular type bag opening fastener members has been employed. This has enabled the sealability and impact resistance of the bag body 1 to be improved.

While a laundry-held bag body with a suitable quantity of washing water and detergent put therein is left as it is for a while, the greater part of the soil and odor deposited on the laundry can be removed owing to an immersion cleaning effect of the water and a surface activating effect of detergent components. Especially, when an external pressure is exerted on the bag body so as to give vibration to the laundry, the water in the bag body is agitated to cause local turbulence to occur. Therefore, the above-mentioned effects are promoted, and a cleaning effect can further be improved.

When the bag body is made of a transparent sheet material, the degree of removal of the soil from the laundry can be ascertained from the outside very conveniently.

The bag body can be mass-produced at a low manufacturing cost by molding a flexible sheet material, such as a plastic film. Therefore, a user can purchase this laundry bag at a very low price, and throw away the same after use substantially non-wastefully.

Furthermore, when laundry is washed by using the laundry bag according to the invention, it is unnecessary to directly utilize a sink, a bathtub and the like which are used by many and unspecified persons. Therefore, it can be said from a sanitary point of view that this laundry bag is a very preferable washing apparatus.

What is claimed is:

1. A portable laundry bag characterized in that the laundry bag is formed by:

providing members for opening and closing the bag on at least two portions of a bag body made of a flexible sheet material;

forming the members for opening and closing the bag by slider-carrying fasteners for opening and closing the bag having paired male and female seal hooks;

providing at least one of the fasteners for opening and closing the bag at the side of an opening thereof with male and female slider guide hooks so that the slider guide hooks extend in parallel with the seal hooks;

providing the slider associated with said at least one of the fasteners with an inner-side guide such that the inner-side guide is positioned between the seal hooks and slider guide hooks;

providing at least one portion of the bag body with means for preventing an outflow of laundry, for preventing the laundry from spilling out of the bag during a water discharging operation carried out after the completion of a laundry washing operation.

2. A portable laundry bag according to claim 1, wherein the slider guide hooks are projections extending toward the inner side of the bag body.

3. A portable laundry bag according to claim 1, wherein the female hooks out of the paired male and female seal hooks are formed as seal type fastener members provided with pressure claws on the inner side thereof, the pressure claws being pressed against bifurcated male hooks projecting toward the side of the female hooks.

4. A portable laundry bag according to claim 1, wherein the fasteners for opening and closing the bag are formed so that one fastener for opening and closing the bag is made of a regular fastener member for opening and closing the bag, with the other made of a seal type fastener member for opening and closing the bag.

5. A portable laundry bag according to claim 1, wherein the means for preventing an outflow of laundry is made of a netted member.

6. A portable laundry bag according to claim 1, wherein the members for opening and closing the bag are formed by watertight fasteners for opening and closing the bag, said fasteners being disposed on one of the edges of the bag body, and said fasteners having means for preventing an outflow of laundry in the vicinity thereof and used exclusively for a water discharging operation.

7. A portable laundry bag according to claim 1, wherein the members for opening and closing the bag are formed by fasteners for opening and closing the bag provided on an upper end portion and a lower end portion respectively of the bag body.

8. A portable laundry bag according to claim 1 wherein the bag body is made of a transparent plastic film.

9. A portable laundry bag according to claim 1, wherein the members for opening and closing the bag are formed by fasteners for opening and closing the bag adapted to carry out the opening and closing of the bag body by the engagement of the male hooks and female hooks with each other, and comprising unsealing prevention claws formed on both sides of the female hooks of the bag opening and closing fasteners, the unsealing prevention claws being provided for tightly holding the male hooks in their midst.

10. A portable laundry bag comprising members provided for opening and closing the bag on at least two portions of a bag body made of a flexible sheet material, said members comprising each a fastener provided for opening and closing the bag, said fastener having paired male and female seal hooks and carrying a slider;

wherein at least the fastener of a first one of the members comprise male and female slider guide hooks extending in parallel with the seal hooks;

wherein the slider carried by said fastener of a first one of the members comprises an inner-side guide provided for being positioned between the seal hooks and the slider guide hooks; and wherein at least one portion of the bag body comprises retention members for preventing laundry from spilling out of the bag during a water discharge operation carried out after the completion of a laundry washing operation by opening the fastener of a second one of the members.

11. The portable laundry bag according to claim 10, wherein the retention member is a netted member.

12. The portable laundry bag according to claim 10, wherein the retention member is comprised of a plurality of bonded portions of the bag body.

* * * * *